US009715191B2

(12) United States Patent
Ogino et al.

(10) Patent No.: US 9,715,191 B2
(45) Date of Patent: Jul. 25, 2017

(54) POWDER FEEDING MECHANISM, POWDER FEEDING METHOD, DEVELOPER ACCOMMODATING CONTAINER, CARTRIDGE AND IMAGE FORMING APPARATUS

(71) Applicant: CANON KABUSHIKI KAISHA, Tokyo (JP)

(72) Inventors: Hiroki Ogino, Mishima (JP); Kojiro Yasui, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/501,261

(22) Filed: Sep. 30, 2014

(65) Prior Publication Data

US 2015/0093153 A1 Apr. 2, 2015

(30) Foreign Application Priority Data

Oct. 1, 2013 (JP) ..... 2013-206714
Jul. 31, 2014 (JP) ..... 2014-156566

(51) Int. Cl.
*G03G 15/08* (2006.01)

(52) U.S. Cl.
CPC ..... *G03G 15/0865* (2013.01); *G03G 15/0891* (2013.01); *G03G 15/0875* (2013.01); *G03G 15/0896* (2013.01); *G03G 2215/0802* (2013.01)

(58) Field of Classification Search
CPC ..... G03G 15/0865; G03G 15/0875; G03G 15/0879; G03G 15/0891; G03G 15/0896; G03G 2215/0802; G03G 2215/068
See application file for complete search history.

(56) References Cited

U.S. PATENT DOCUMENTS 3,224,649 A 12/1965 Gunto
3,985,098 A * 10/1976 Myers ..... G03G 15/0891 222/241
5,414,497 A 5/1995 Tsuchiya et al.
6,681,088 B2 1/2004 Kanno et al.
(Continued)

FOREIGN PATENT DOCUMENTS

JP 55-9227618 A 12/1984
JP H04-125214 A 4/1992
(Continued)

OTHER PUBLICATIONS

Extended Search Report in European Patent Application No. 14186954.5, dated Jan. 28, 2015.

*Primary Examiner* — David M Gray
*Assistant Examiner* — Laura Roth
(74) *Attorney, Agent, or Firm* — Fitzpatrick, Cella, Harper & Scinto

(57) ABSTRACT

A powder feeding mechanism includes: a feeding member, provided under powder, for feeding the powder; and a vibration applying member for applying reciprocating acceleration to the feeding member in a feeding surface direction along a powder feeding surface of the feeding member. Maximum acceleration applied from the vibration applying member to the feeding member in a powder feeding direction is smaller than maximum acceleration applied from the vibration applying member to the feeding member in a direction opposite to the powder feeding direction to feed the powder in the powder feeding direction by the feeding member.

16 Claims, 9 Drawing Sheets

(56) References Cited

U.S. PATENT DOCUMENTS

| | | | | |
|---|---|---|---|---|
| 6,859,629 | B2 | 2/2005 | Miura et al. | |
| 6,978,100 | B2 | 12/2005 | Yasui et al. | |
| 7,016,626 | B2 | 3/2006 | Yokomori et al. | |
| 7,068,965 | B2 | 6/2006 | Yoshino et al. | |
| 7,079,787 | B2 | 7/2006 | Ogiuno et al. | |
| 7,085,516 | B2 | 8/2006 | Kawai et al. | |
| 7,127,192 | B2 | 10/2006 | Batori et al. | |
| 7,155,137 | B2 | 12/2006 | Yasui et al. | |
| 7,418,225 | B2 | 8/2008 | Morioka et al. | |
| 2002/0025195 | A1 | 2/2002 | Iwata et al. | |
| 2009/0060590 | A1 | 3/2009 | Kurogawa | |
| 2009/0080941 | A1* | 3/2009 | Nishiwaki | G03G 15/0887 399/254 |
| 2009/0129822 | A1* | 5/2009 | Toh | G03G 15/0877 399/258 |
| 2012/0163876 | A1 | 6/2012 | Wada | |
| 2013/0343785 | A1 | 12/2013 | Matsuzaki et al. | |
| 2014/0016961 | A1 | 1/2014 | Yasui et al. | |
| 2014/0029974 | A1 | 1/2014 | Uesugi et al. | |
| 2014/0064793 | A1 | 3/2014 | Matsuzaki et al. | |
| 2014/0072329 | A1 | 3/2014 | Uesugi et al. | |
| 2014/0072330 | A1 | 3/2014 | Yoshida et al. | |
| 2014/0072346 | A1 | 3/2014 | Furutani et al. | |
| 2014/0079432 | A1 | 3/2014 | Matsuzaki et al. | |
| 2014/0199094 | A1 | 7/2014 | Matsuzaki et al. | |
| 2014/0199096 | A1 | 7/2014 | Yoshida et al. | |
| 2014/0363196 | A1 | 12/2014 | Wada et al. | |
| 2016/0282758 | A1* | 9/2016 | Kawata | G03G 15/0865 |

FOREIGN PATENT DOCUMENTS

| | | | | |
|---|---|---|---|---|
| JP | 04178671 | A | * | 6/1992 |
| JP | 08114985 | A | * | 5/1996 |
| JP | H08-114985 | A | | 5/1996 |
| JP | 09244372 | A | * | 8/1997 |
| JP | 2829938 | B | | 4/2002 |
| JP | 2002-196585 | A | | 7/2002 |
| JP | 2002268346 | A | * | 9/2002 |

* cited by examiner

POWDER FEEDING MECHANISM, POWDER FEEDING METHOD, DEVELOPER ACCOMMODATING CONTAINER, CARTRIDGE AND IMAGE FORMING APPARATUS

FIELD OF THE INVENTION AND RELATED ART

The present invention relates to a powder feeding mechanism, a powder feeding method, a developer accommodating container, a cartridge and an image forming apparatus.

Here, the image forming apparatus is, e.g., an electrophotographic copying machine for forming an image on a recording material (medium) by using an electrophotographic image forming type, an electrophotographic printer (such as a laser beam printer or an LED printer), a facsimile machine, or the like.

Various feeding devices for feeding powder such as a developer have been conventionally known (Japanese Laid-Open Patent Application (JP-A) 2002-196585, JP-A Sho 59-227618 and JP-A Hei 08-114985). As described in JP-A 2002-196585, a constitution in which a stirring feeding member for feeding an accommodated developer toward a developing roller while stirring the developer is provided inside a developer accommodating container detachably mountable to an inside portion of an image forming apparatus is disclosed. In this constitution, a plurality of stirring feeding members are used.

Further, as described in JP-A Sho 59-227618, a constitution of a particulate feeding device in which a particulate carrying member swingably supported and a vibration generating device for applying vibration to the carrying member are provided and in which particulates carried by the carrying member are fed by vibrating the carrying member is disclosed.

Further, as described in JP-A Hei 08-114985, a constitution in which a developer guiding plate for feeding a developer and a vibrating device for applying vibration to the developer guiding plate are provided and in which the developer on the developer guiding plate is fed by vibrating the developer guiding plate is disclosed.

However, in the constitution of JP-A 2002-196585, the stirring feeding member can feeding only the developer in a range of a radius of rotation, and therefore there is a need to constitute a bottom of the accommodating container in an arcuate shape as seen in a cross-section. Accordingly, there is a need to prevent the developer from stagnating in a region of a projected portion formed on a floor surface, of the accommodating container, where the stirring feeding member reaches the floor surface. However, this projected portion constitutes a dead space.

Further, in the constitution of JP-A Sho 59-227618, there is a need to ensure a space for permitting swing of the carrying member, and this space constitutes the dead space.

Further, in the constitution of JP-A Hei 08-114985, in order to support the developer guiding plate by a developing container, the developer guiding plate and the developing container are connected by a leaf spring member, and therefore a space in which the leaf spring member is provided constitutes the dead space.

SUMMARY OF THE INVENTION

A principal object of the present invention is to provide a powder feeding mechanism capable of reducing a dead space of a powder feeding path compared with the conventional constitutions.

According to an aspect of the present invention, there is provided a powder feeding mechanism comprising: a feeding member, provided under powder, for feeding the powder; and a vibration applying member for applying reciprocating acceleration to the feeding member in a feeding surface direction along a powder feeding surface of the feeding member, wherein maximum acceleration applied from the vibration applying member to the feeding member in a powder feeding direction is smaller than maximum acceleration applied from the vibration applying member to the feeding member in a direction opposite to the powder feeding direction to feed the powder in the powder feeding direction by the feeding member.

According to another aspect of the present invention, there is provided a powder feeding mechanism comprising: a feeding member, provided under powder, for feeding the powder; and a vibration applying member for applying reciprocating acceleration to the feeding member in a direction perpendicular to a powder feeding surface of the feeding member to vibrate, wherein at least a part of the feeding member is fixed and a progressive wave to be generated from the vibration applying member as a source is generated in the feeding member to feed the powder in an advancing direction of the progressive wave.

According to the present invention, the dead space of the powder feeding path can be reduced compared with the conventional constitutions.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiments of the present invention will be described with reference to the drawings. However, dimensions, materials, shapes, relative arrangements of constituent elements (parts) and the like described in the following embodiments do not limit the scope of the present invention thereto unless otherwise specified. Further, in the following embodiments, materials, shapes and the like of members once described are similar to those first described unless otherwise particularly specified again.

In the following description, a longitudinal direction of a cartridge is an axial direction of an image bearing member. Further, left and right are those when a recording material is seen from above along a feeding direction (conveyance direction) of the recording material. Further, an upper surface of the cartridge is a surface positioned at an upper portion in a state in which the cartridge is mounted in an apparatus main assembly, and a lower surface of the cartridge is a surface positioned at a lower portion in the state.

Embodiment 1

(General Structure of Image Forming Apparatus)

Figure 1:
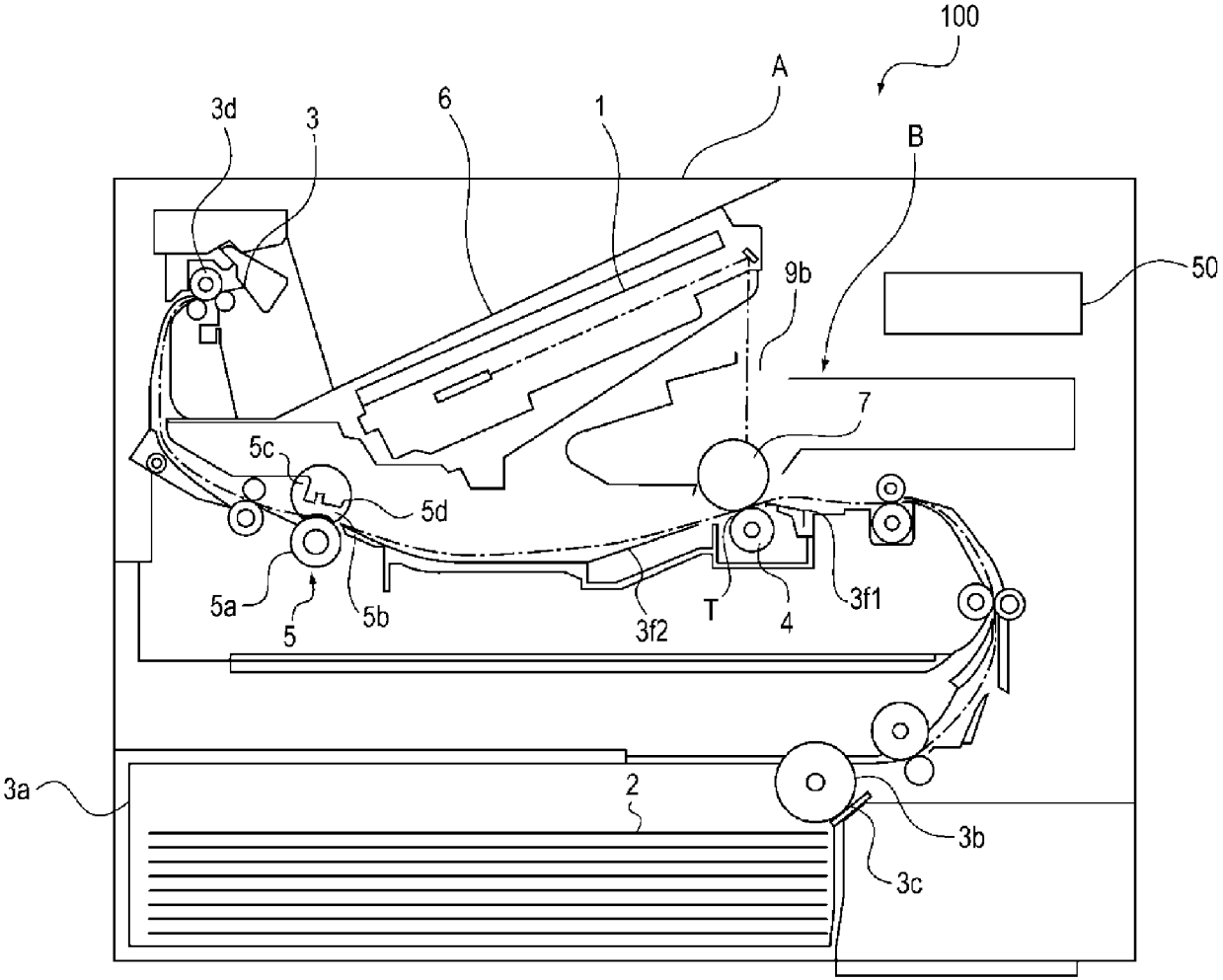
FIG. 1 is a sectional view of an image forming apparatus according to Embodiment 1.

First, a general structure of an electrophotographic image forming apparatus 100 will be described with reference to FIG. 1. FIG. 1 is a schematic sectional view of the image forming apparatus 100 in which a cartridge B according to Embodiment 1 is mounted. More specifically, FIG. 1 is the schematic sectional view of a laser beam printer as an example of the image forming apparatus 100.

As shown in FIG. 1, the image forming apparatus 100 (laser beam printer) includes an apparatus main assembly A for image formation and the cartridge B detachably mountable to the apparatus main assembly A. Inside the apparatus main assembly A, a photosensitive drum 7 is provided.

Further, in the image forming apparatus 100, information light on the basis of image information is emitted from an optical system 1 as an optical means (optical device) to a drum-shaped photosensitive drum 7, so that an electrostatic latent image is formed on the photosensitive drum 7. This electrostatic latent image is developed with a developer (hereinafter referred to as a toner), so that a toner image is formed. Then, in synchronism with the formation of the toner image, a recording material (e.g., recording paper, OHP sheet, cloth or the like) 2 is separated and fed one by one from a cassette 3*a* by a pick-up roller 3*b* and a press-contact member 3*c* which press-contacts the pick-up roller 3*b*.

The fed recording material 2 is conveyed along a conveying guide 3*f*1 to a transfer portion T where the photosensitive drum 7 of the process cartridge B and a transfer roller 4 as a transfer means oppose each other. Onto the recording material 2 conveyed to the transfer portion T, the toner image formed on the photosensitive drum 7 is transferred by the transfer roller 4 to which a voltage is applied, and then the recording material 2 is conveyed along a conveying guide 3*f*2 to a fixing device 5.

The fixing device 5 includes a driving roller 5*a* and a rotatable fixing member 5*d* which incorporates a heater 5*b* and which is constituted by a cylindrical sheet rotatably supported by a supporting member 5*c*. The fixing device 5 applies heat and pressure to the recording material 2 passing through the fixing device 5, thus fixing the transferred toner image on the recording material 2.

A discharging roller 3*d* is constituted so that it conveys the recording material 2 on which the toner image is fixed and discharges the recording material 2 toward a discharging portion 6 via a reverse conveying path. Incidentally, in this embodiment, the pick-up roller 3*b*, the press-contact member 3*c*, the discharging roller 3*d*, and the like constitute a conveying device 3. Incidentally, a controller 50 controls drive of the apparatus main assembly A and internal equipment. Particularly, the controller 50 controls drive of a vibratable member 13 as a vibration applying member and a cam member 15 (described later).

(Cartridge)

Figure 2:
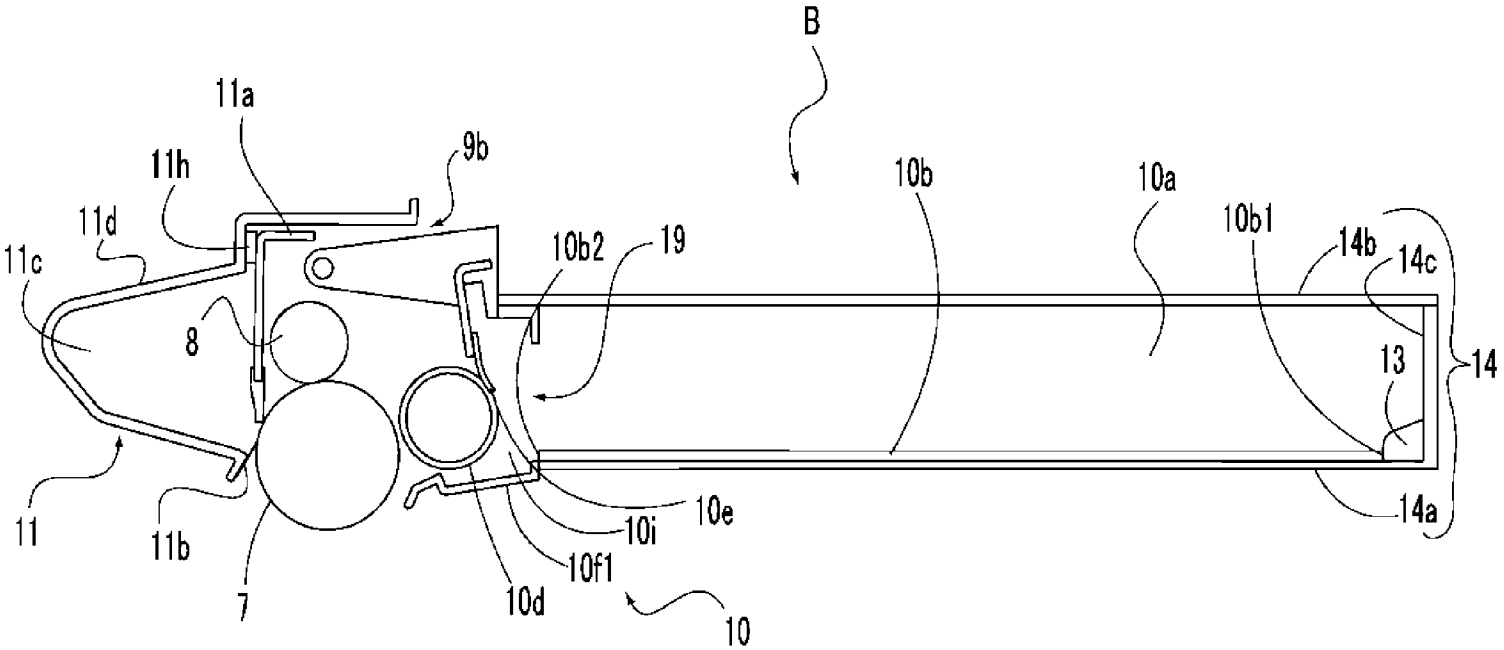
FIG. 2 is a sectional view of a cartridge according to Embodiment 1.

Next, the general structure of the cartridge B (process cartridge) will be schematically described with reference to FIG. 2. FIG. 2 is a schematic sectional view of the cartridge B.

As shown in FIG. 2, the cartridge B includes the photosensitive drum 7 as an image bearing member for bearing a developer image and includes at least one process means. Here, as the process means, there are, e.g., a charging means for electrically charging the photosensitive drum 7, a developing means for developing the electrostatic latent image formed on the photosensitive drum 7, a cleaning means for removing the toner remaining on the photosensitive drum 7, and the like.

In the process cartridge B, the photosensitive drum 7 provided with a photosensitive layer is rotated and a surface thereof is uniformly charged by applying a voltage to a charging roller 8 as the charging means. The charged surface of the photosensitive drum 7 is exposed, through an exposure opening 9*b*, to information light (light image) on the basis of image information from an optical system 1 (FIG. 1), so that the electrostatic latent image is formed on the surface of the photosensitive drum 7, and then the electrostatic latent image is to be developed by a developing unit 10. The developing unit 10 is a developing device.

The developing unit 10 includes accommodates the toner in a toner accommodating portion 10*a* formed by a container body 14*a* and a container cap member 14*b* of an accommodating container 14 as a developer accommodating container. A developer feeding member 10*b* feeds the toner, in the toner accommodating portion 10*a*, toward a developing chamber 10*i*.

Then, in the developing unit 10, a developing roller 10*d* as a developer carrying member for carrying the developer is rotated. With this rotation, a toner layer to which triboelectric charges are provided by a developing blade 10*e* is formed on a surface of the developing roller 10*d*, and then the toner is transferred onto the photosensitive drum 7 depending on the electrostatic latent image, so that the toner image is formed to provide a visible image.

Then, a voltage of an opposite polarity to the charge polarity of the toner image is applied to the transfer roller 4, so that the toner image is transferred onto the recording material 2. Thereafter, the toner remaining on the photosensitive drum 7 is scraped off by a cleaning blade 11*a* fixed to a drum frame 11*d* at a feeding direction 11*h*. At the same time, the toner is scooped by a receptor sheet 11*b*, so that the toner is collected in a removed toner accommodating portion 11*c*. A constitution in which the residual toner on the photosensitive drum 7 is removed by these cleaning means is employed.

The cartridge B includes a drum unit 11 constituted by a drum frame 11 which rotatably supports the photosensitive drum 7 and in which the cleaning blade 11*a* and the charging roller 8 are incorporated. Further, the cartridge B includes the developing unit 10 constituted by a developing (device) frame 10*f*1 in which the developing roller 10*d* and the toner accommodating portion 10*a* are incorporated. The cartridge B includes the drum unit 11 and the developing unit 10.

1. Toner Feeding by Progressive Wave (Mechanism 1)
(Toner Feeding Constitution of Developer Feeding Mechanism)

Next, a toner feeding constitution of a developer feeding mechanism 200 will be specifically described with reference to FIGS. 1 to 3. Here, the developer feeding mechanism 200 includes the accommodating container 14, the feeding member 10*b* and the vibratable member 13.

Figure 3:
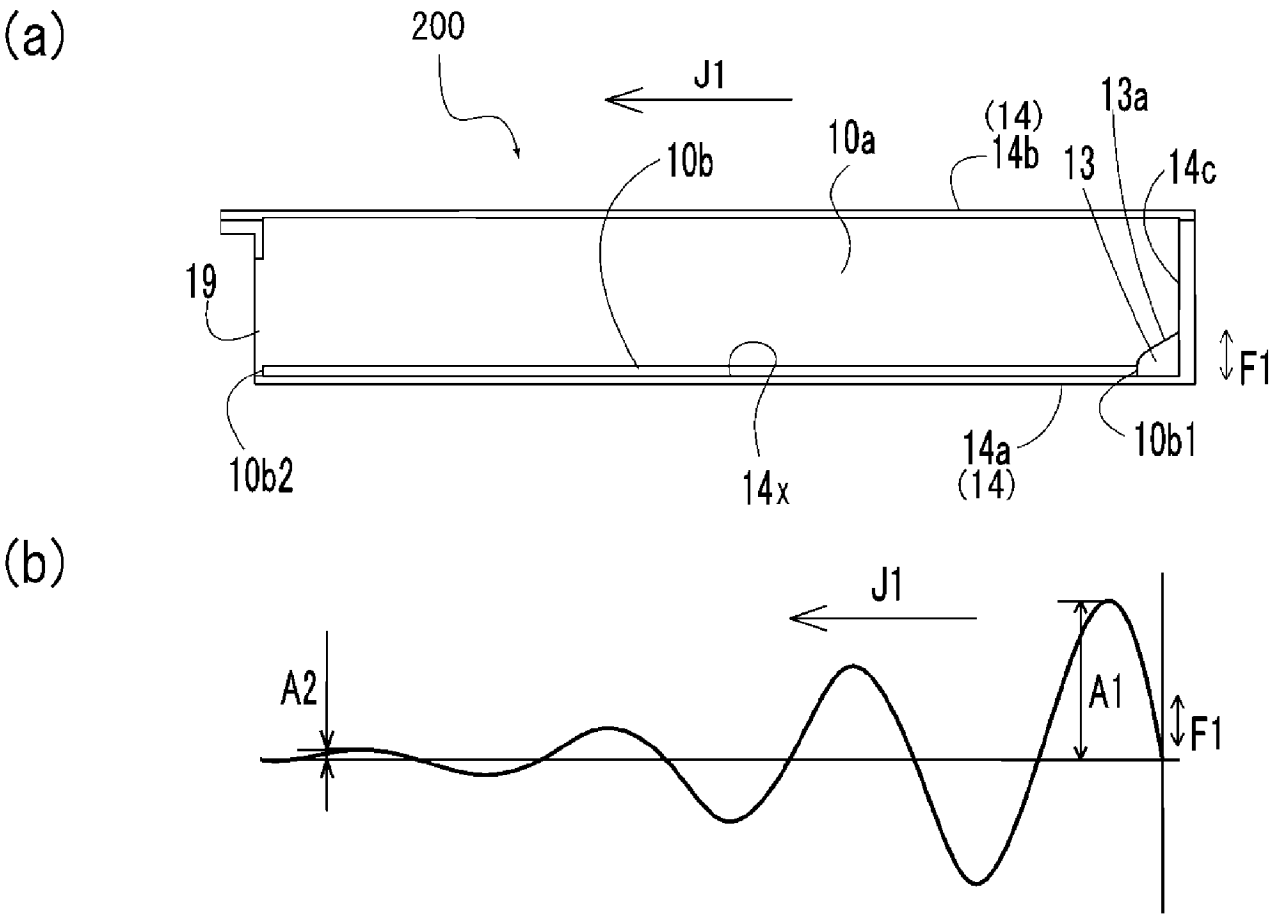
In FIG. 3, (a) is a sectional view of a developer feeding mechanism according to Embodiment 1, and (b) is a waveform chart of a powder in Embodiment 1.

In FIG. 3, (a) is a sectional view of the developer feeding mechanism 200, and (b) is a waveform chart of a progressive wave. As shown in FIG. 3, the developer feeding mechanism 200 as a powder feeding mechanism includes the accommodating container 14 for accommodating powder (developer in this embodiment). The accommodating container 14 includes the container body 14*a* and the container cap member 14*b*. When the container cap member 14*b* is mounted to the container body 14*a*, an opening 19 is formed. Further, when the cartridge B is mounted in the apparatus main assembly A, a floor surface 14*x* of the container body 14*a* is set so as to be substantially horizontal. Incidentally, the opening 19 is an opening for permitting supply of the toner, in the accommodating container 14, toward the developing roller 10*d* (FIG. 2).

Next, the feeding member 10*b* will be described. The feeding member 10*b* is disposed under the powder, and is a plate-like member for feeding the developer. The feeding member 10*b* is disposed on the floor surface 14*x* of the accommodating container 14. The feeding member 10*b* is constituted so that at least a part of the feeding member 10*b* is fixed to the vibratable member 13, and a progressive wave to be generated from the vibratable member 13 as a (generating) source is generated in the feeding member 10*b* (progressive wave generating step) and the developer is fed in a feeding direction J1 as a powder feeding direction by the feeding member 10*b* (powder feeding step). This feeding direction J1 can also be expressed as an advancing direction of the progressive wave.

Incidentally, the developer feeding mechanism 200 is different from a constitution in which the accommodating container 14 is directly vibrated or swung, and is a constitution in which the feeding member 10*b* placed on the floor surface 14*x* of the accommodating container 14 is vibrated. This is because in the case where the accommodating container 14 is vibrated or swung, a mechanism for vibrating or swinging the accommodating container 14 is required to be provided outside the accommodating container 14 and there is a need to ensure a space therefor, and therefore the mechanism and the space are useless and thus the constitution of the above-described embodiment is employed. Further, the above constitution is employed also for avoiding a situation such that when the accommodating container 14 is directly vibrated or swung, an error or the like is generated with respect to positional accuracy of the developing roller 10*d* assembled with the accommodating container 14 and can adversely affect image formation.

With respect to the feeding member 10*b*, a free end thereof with respect to the feeding direction J1 is a free end portion 10*b*2, and a base end thereof with respect to the feeding direction J1 is a fixing portion 10*b*1. The fixing portion 10*b*1 is fixed to the vibratable member 13 for transmitting vibration to the feeding member 10*b* and constitutes a fixed end. The free end portion 10*b*2 is not fixed to the floor surface 14*x* and constitutes the free end.

Further, as a material for the feeding member 10*b*, a 300 μm-thick silicone rubber is used, but the material may also be not limited to this silicone rubber material. The material for the feeding member 10*b* may also be a general-purpose elastomer material such as acrylic rubber, natural rubber or butyl rubber. The material for the feeding member 10*b* may also be a general-purpose plastic material such as polyethylene terephthalate (PET), polystyrene (PS), polyethylene (PE), polypropylene (PP), ABS resin, polycarbonate (PC) or polyacetal (POM).

Next, the vibratable member 13 will be described. The vibratable member 13 applies reciprocating acceleration to the feeding member 10*b* in a perpendicular direction perpendicular to a developer feeding surface as a powder feeding surface to vibrate. The vibratable member 13 is disposed upstream of the feeding member 10*b* with respect to the feeding direction J1.

When the vibratable member 13 vibrates in the perpendicular direction F1 to the feeding member 10*b*, the vibration of the vibratable member 13 is transmitted to the feeding member 10*b* via the feeding direction 10*b*1, so that the feeding member 10*b* vibrates in the toner accommodating portion 10*a*. Here, a vibration frequency of 40 Hz and an amplitude of about 0.8 mm were selected. The vibratable member 13 is disposed in the neighborhood of a rear end portion 14*c* opposite from the opening 19 of the accommodating container 14, and at an upper portion thereof, an inclined surface portion 13*a* is formed.

Further, the vibratable member 13 is constituted by a member vibratable by a general-purpose vibration applying device body or vibration applying device, capable of generating vibration, such as a piezoelectric element.

Here, as shown in FIG. 3, when the vibratable member 13 vibrates, the fixing portion 10*b*1 of the feeding member 10*b* reciprocates in the perpendicular direction F1 to the feeding member 10*b*, so that the vibration is transmitted from the fixing portion 10*b*1 toward the free end portion 10*b*2 of the feeding member 10*b*. At this time, a maximum amplitude A1, generated by the vibratable member 13, in the feeding direction 10*b*1 side of the feeding member 10*b* is larger than a maximum amplitude A2 in the free end portion 10*b*2 side of the feeding member 10*b*.

This is because the amplitude of the vibration applied to the feeding member 10*b* is attenuated by absorption of the vibration by the feeding member 10*b* itself. As a result, the progressive wave in which a peak-to-valley portion of the feeding member 10*b* moves from the fixing portion 10*b*1 side toward the free end portion 10*b*2 side generates.

Here, of the toner positioned at an inclined surface portion of the progressive wave, there is a toner (component) which cannot remain on the inclined surface but drops into the valley portion of the progressive wave. At this time, the valley portion moves together with the progressive wave, and therefore by repeating this operation, it becomes possible to feed the toner in the same direction as a direction of the progressive wave.

Accordingly, by the progressive wave moving from the fixing portion 10*b*1 toward the free end portion 10*b*2, the toner on the feeding member 10*b* is fed in the direction (feeding direction) J1 directed toward the opening 19 side of the accommodating container 14.

Here, in the case of a high frequency such as a vibration period of 50 kHz, as described in Japanese Patent No. 2829938, it is well-known that the toner moves in a direction opposite to the direction of the progressive wave. However, as in this embodiment, in a low-frequency region, it would be considered that this feeding mechanism is not applied but the toner means in the direction of the progressive wave in accordance with the mechanism described above.

Further, the inclined surface portion 13*a* is provided at the upper portion of the vibratable member 13, and therefore the toner on the vibratable member 13 can slip on the inclined surface portion 13*a* by vibration of the vibratable member 13 to reach the feeding member 10*b*. For this reason, the inclined surface portion 13*a* prevents the toner from remaining on the vibratable member 13.

Embodiment 2

2. Toner Feeding by Acceleration (Mechanism 2)

Figure 4:
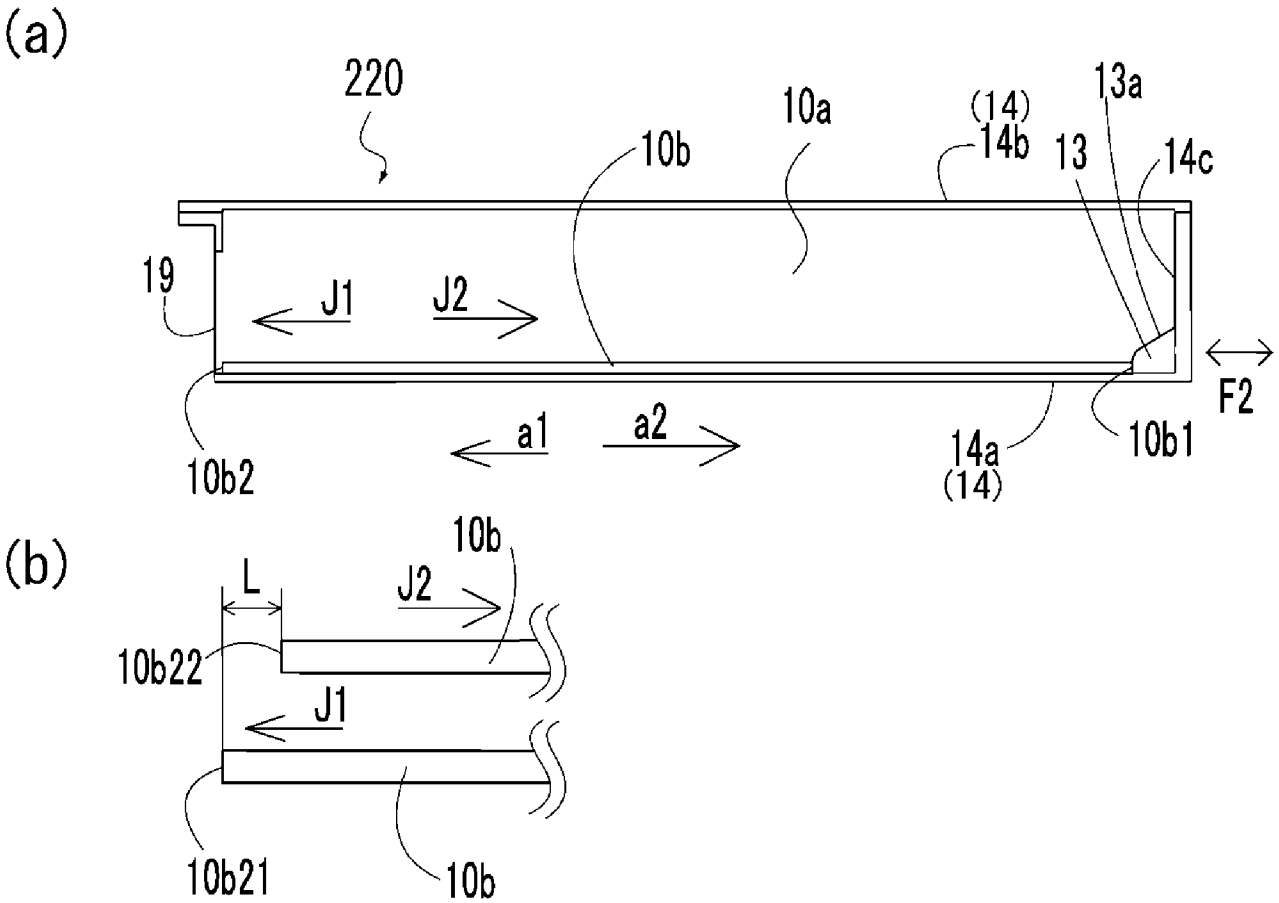
In FIG. 4, (a) is a sectional view of a developer feeding mechanism according to Embodiment 2, and (b) is a partly enlarged sectional view of (a) of FIG. 4.

Here, the toner feeding constitution of the developer feeding mechanism is not limited to the constitution described above. For example, the toner feeding constitution may also be a toner feeding constitution of a developer feeding mechanism 220 shown in FIG. 4. In FIG. 4, (a) is a sectional view of the developer feeding mechanism 220, and (b) is a partly enlarged sectional view of (a) of FIG. 4. Incidentally, in Embodiment 2, constituent elements identical to those in Embodiment 1 are represented by the same reference numerals or symbols and will be omitted from description. The description in Embodiment 1 is applied to also this embodiment.

(Toner Feeding Constitution of Developer Feeding Mechanism)

The toner feeding constitution of the developer feeding mechanism in this embodiment will be described specifically with reference to FIGS. 1, 2 and 4. Incidentally, of the constituent elements in this embodiment, those similar to those in Embodiment 1 are represented by the same reference numerals or symbols, and the description in Embodiment 1 is applied to also this embodiment and will be omitted from description in this embodiment.

As a material for the feeding member 10*b*, a 1 mm-thick polystyrene (PS) was used, but the material is not limited to the polystyrene material. The material for the feeding member 10*b* can also be appropriately constituted by a general-purpose plastic material such as polyethylene terephthalate (PET), polyethylene (PE), polypropylene (PP), ABS resin, polycarbonate (PC) or polyacetal (POM) or by a general-purpose elastomer material such as silicone rubber, acrylic rubber, natural rubber or butyl rubber.

As shown in FIG. 4, the vibratable member (vibration applying member) 13 applies reciprocating acceleration to the feeding member 10*b* in a feeding surface direction F2 along a developer feeding surface to vibrate. When the vibratable member 13 vibrates, the vibration of the vibratable member (vibration applying member) 13 is transmitted to the feeding member 10*b* via the vibratable member (vibration applying member) 13 and the fixing portion 10*b*1 of the feeding member 10*b*, so that the feeding member 10*b* vibrates in the toner accommodating portion 10*a*.

At this time, by the vibration of the vibratable member 13, the free end portion 10*b*2 of the feeding member 10*b* moves to a position 10*b*21 where the free end portion 10*b*2 moves in a feeding direction J1 to the maximum, and moves to a position 10*b*22 where the free end portion moves in an opposite direction J2, opposite to the feeding direction J1, to the maximum.

Here, a vibration frequency of 50 Hz of the vibratable member 13 and a movement length L, of about 0.6 mm, which is difference between the positions 10*b*21 and 10*b*22 of the free end portion 10*b*2 of the feeding member 10*b* were selected.

As shown in FIG. 4, the feeding member 10*b* is provided with the free end portion 10*b*2 as a free end in the opening 19 side of the accommodating container 14, and is provided with the fixing portion 10*b*1 fixed to the vibratable member (vibration applying member) 13 in the opposite side from the free end portion 10*b*2.

Here, when the vibratable member (vibration applying member) 13 vibrates in the feeding surface direction F2 crossing the thickness direction of the feeding member 10*b*, the fixing portion 10*b*1 of the feeding member 10*b* vibrates, so that the vibration is transmitted from the fixing portion 10*b*1 toward the free end portion 10*b*2 of the feeding member 10*b*. At this time, by the vibration of the vibratable member (vibration applying member) 13, maximum acceleration a1 in the feeding direction J1 and maximum acceleration a2 in the opposite direction J2 to the feeding direction J1 are applied to the feeding member 10*b*.

Here, the maximum accelerational applied from the vibratable member (vibration applying member) 13 to the feeding member 10*b* in the feeding direction J1 is set at a value smaller than the maximum acceleration a2 applied from the vibratable member 13 to the feeding member 10*b* in the opposite direction J2 to the feeding direction J1 (acceleration setting step). Further, the maximum acceleration in the opposite direction J2 to the feeding direction J1 is set at acceleration at which the slides on the feeding member 10*b*. By such an acceleration setting step, the toner is fed in the feeding direction J1 by the feeding member 10*b* (powder feeding step).

Here, by setting the acceleration so that the maximum accelerational directed in the feeding direction J1 of the feeding member 10*b* is smaller than the maximum acceleration a2 directed in the opposite direction J2 to the feeding direction J1, a toner slipping distance on the feeding member 10*b* is longer during movement in the opposite direction J2 (to the feeding direction J1) than during movement in the feeding direction J1. Further, when the feeding member 10*b* moves in the opposite direction J2 to the feeding direction J1, the toner slipping on the feeding member 10*b* moves in the feeding direction J1 on the feeding member 10*b* relative to the fixing portion 10*b*1. As a result, by repeating the vibration described above, the toner on the feeding member 10*b* is gradually fed in the feeding direction J1.

On the other hand, in the case where the feeding member 10*b* moves at the maximum acceleration a2 at which the toner does not slip on the feeding member 10*b* in the opposite direction J2 to the feeding direction J1, the toner is not fed. That is, in the present invention, when the feeding member 10*b* moves in the opposite direction J2 opposite to the feeding direction J1, the feeding member 10*b* is required to have the maximum acceleration such that the toner can slip on the feeding member 10*b*.

Figure 5:
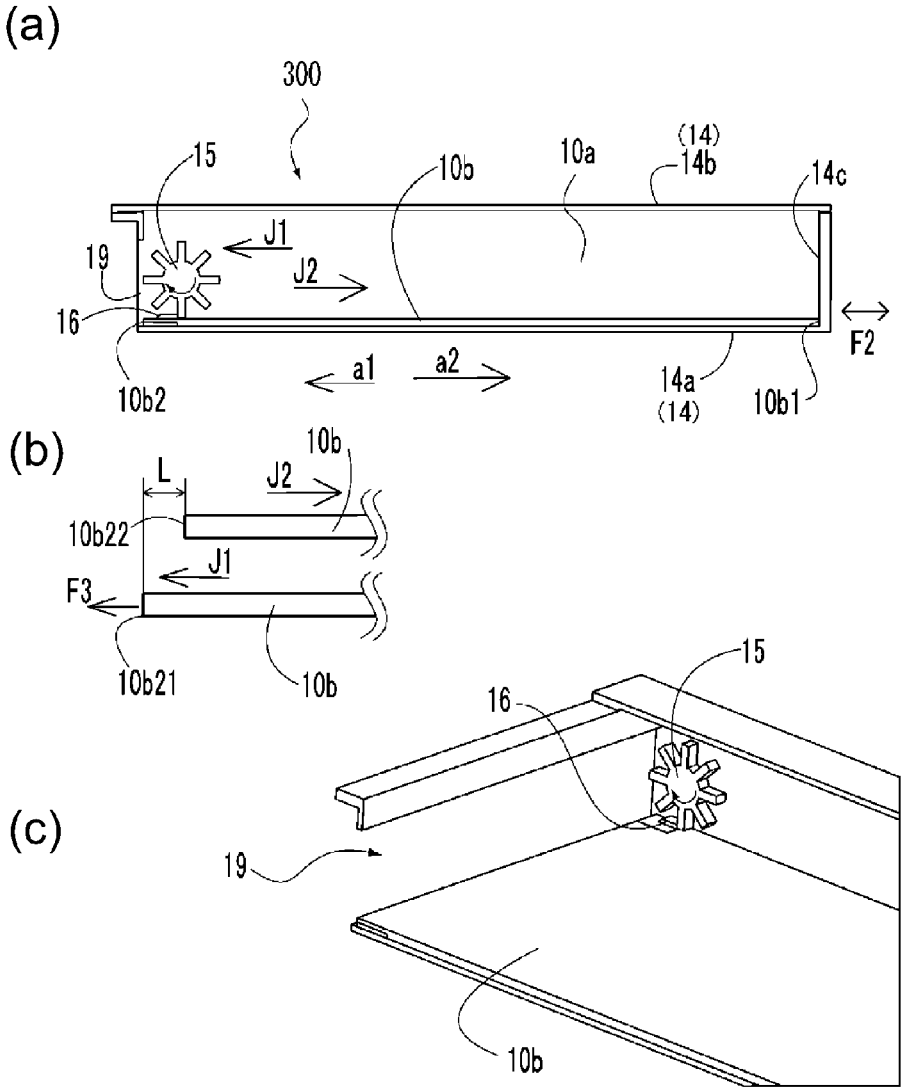
In FIG. 5, (a) is a sectional view of a developer feeding mechanism according to Embodiment 3, (b) is a partly enlarged sectional view of (a) of FIG. 5, and (c) is a perspective view of the developer feeding mechanism.

At this time, the slip of the toner on the vibrating feeding member 10*b* is not limited to slip, between the feeding member 10*b* and the toner, generated at an interface between the feeding member 10*b* and the toner, but may also include slip generated at an interface between the toner (component) and an upper toner (component) positioned on the toner. Further, the vibration applying member 13 is not limited to the constitution described above, but may also be a constitution, as shown in FIG. 5, such that vibration is applied to a contact portion 16, provided on the feeding member 10*b*, by a rotating cam member 15.

Embodiment 3

3. Toner Feeding by Acceleration (Mechanism 2) (Rubber Feeding Member)

Here, the toner feeding constitution of the developer feeding mechanism is not limited to the constitution described above. For example, the toner feeding constitution may also be a toner feeding constitution of a developer feeding mechanism 300 shown in FIG. 5. In FIG. 5, (a) is a sectional view of the developer feeding mechanism 300 according to Embodiment 3, (b) is a partly enlarged sectional view of (a) of FIG. 5 and (c) is a perspective view of the developer feeding mechanism 300. Incidentally, of constituent elements in Embodiment 3, those identical to those in Embodiments 1 and 2 are represented by the same reference numerals or symbols and will be omitted from description. The description in each of Embodiments 1 and 2 is applied to also this embodiment.

(Toner Feeding Constitution of Developer Feeding Mechanism)

The toner feeding constitution of the developer feeding mechanism 300 in this embodiment will be described specifically with reference to FIGS. 1, 2 and 5. Here, the developer feeding mechanism 300 includes the accommodating container 14 and the feeding member 10*b*.

Further, as a material for the feeding member 10*b*, a 0.3 mm-thick silicone rubber was used, but the material is not limited to the silicone rubber. The material for the feeding member 10*b* can also be appropriately constituted by a general-purpose elastomer material such as acrylic rubber, natural rubber or butyl rubber.

As shown in FIG. 5, the feeding member 10*b* in the toner accommodating portion 10*a* is fixed to the accommodating container 14 at the fixing portion 10*b*1. In this way, the feeding member 10*b* may only be required to be fixed at least one position.

As shown in FIG. 5, an operation in which the free end portion 10*b*2 of the feeding member 10*b* is pulled in the feeding direction J1 by a force F3 and then the pulling is eliminated is performed periodically.

In this embodiment, the feeding member 10*b* is provided with the contact portion 16 for accelerating reciprocating motion of the feeding member 10*b* in the feeding surface direction F2 crossing the thickness direction of the feeding member 10*b* in the accommodating container 14. Further, in the accommodating container 14, a rotatable cam member 15 as a vibratable member (vibration applying member) is disposed so as to oppose the contact portion 16 provided on the feeding member 10*b*.

The cam member 15 applies reciprocating acceleration to the feeding member 10*b* via the contact portion 16 in the feeding surface direction F2 along the developer feeding surface to expand and contract the feeding member 10*b*. As a result, the vibration for reciprocating the feeding member 10*b* in the feeding surface direction is applied.

The case where the contact portion 16 capable of reciprocating in the feeding surface direction F2 crossing the thickness direction of the feeding member 10*b* is moved in the accommodating container 14 by the cam member 15 is described as an example, but the contact portion 16 may also be moved by a vibration applying device (vibration applying member) such as a piezoelectric element.

As a result, the feeding member 10*b* constituted by the silicone rubber which is a high elastic member repeats expansion and contraction, thus vibrating in the feeding surface direction F2 crossing the thickness direction of the feeding member 10*b* in the toner accommodating portion 10*a*.

At this time, by the vibration of the vibratable member 13, the free end portion 10*b*2 of the feeding member 10*b* moves to a position 10*b*21 where the free end portion 10*b*2 moves in a feeding direction J1 to the maximum, and moves to a position 10*b*22 where the free end portion moves in an opposite direction J2, opposite to the feeding direction J1, to the maximum.

Here, a vibration frequency of 50 Hz of the force F3 applied to the free end portion 10*b*2 of the feeding member 10*b* and a movement length L, of about 0.6 mm, which is difference between the positions 10*b*21 and 10*b*22 of the free end portion 10*b*2 of the feeding member 10*b* were selected. Further, an elastic force, of the feeding member 10*b*, of about 200 gf/mm and a toner weight of about 100 g were selected.

The feeding member 10*b* vibrates by periodically performing the operation in which the free end portion 10*b*2 of the feeding member 10*b* is pulled in the feeding direction J1 by the force F2 and then the pulling is eliminated. By this vibration, maximum accelerational in the feeding direction J1 and maximum acceleration a2 in the opposite direction J2 to the feeding direction J1 are applied to the feeding member 10*b*.

Here, the maximum acceleration a1 applied from the cam member 15 to the feeding member 10*b* in the feeding direction J1 is set at a value smaller than the maximum acceleration a2 applied from the cam member 15 to the feeding member 10*b* in the opposite direction J2 to the feeding direction J1 by adjusting the number of rotation of the cam member 15 (acceleration setting step). By such an acceleration setting step, the developer is fed in the feeding direction J1 by the feeding member 10*b* (powder feeding step).

Here, by setting the acceleration so that the maximum acceleration a1 in the feeding direction J1 of the feeding member 10*b* is smaller than the maximum acceleration a2 in the opposite direction J2, a toner slipping distance on the feeding member 10*b* is longer during movement in the opposite direction J2 than during movement in the feeding direction J1. Further, when the feeding member 10*b* moves in the opposite direction J2 to the feeding direction J1, the toner slipping on the feeding member 10*b* moves in the feeding direction J1 on the feeding member 10*b* relative to the fixing portion 10*b*1. As a result, by repeating the vibration described above, the toner on the feeding member 10*b* is gradually fed in the feeding direction J1.

On the other hand, in the case where the feeding member 10*b* moves at the maximum acceleration a2 at which the toner does not slip on the feeding member 10*b* in the opposite direction J2 to the feeding direction J1, the toner is not fed. That is, in the present invention, when the feeding member 10*b* moves in the opposite direction J2 opposite to the feeding direction J1, the feeding member 10*b* is required to have the maximum acceleration such that the toner can slip on the feeding member 10*b*.

At this time, the slip of the toner on the vibrating feeding member 10*b* is not limited to slip, between the feeding member 10*b* and the toner, generated at an interface between the feeding member 10*b* and the toner, but may also include slip generated at an interface between the toner (component) and an upper toner (component) positioned on the toner. Further, the vibration applying member 13 is not limited to the constitution described above, but may also be a constitution, as shown in FIG. 5, such that vibration is applied to a contact portion 16, provided on the feeding member 10*b*, by a rotating cam member 15.

Figure 6:
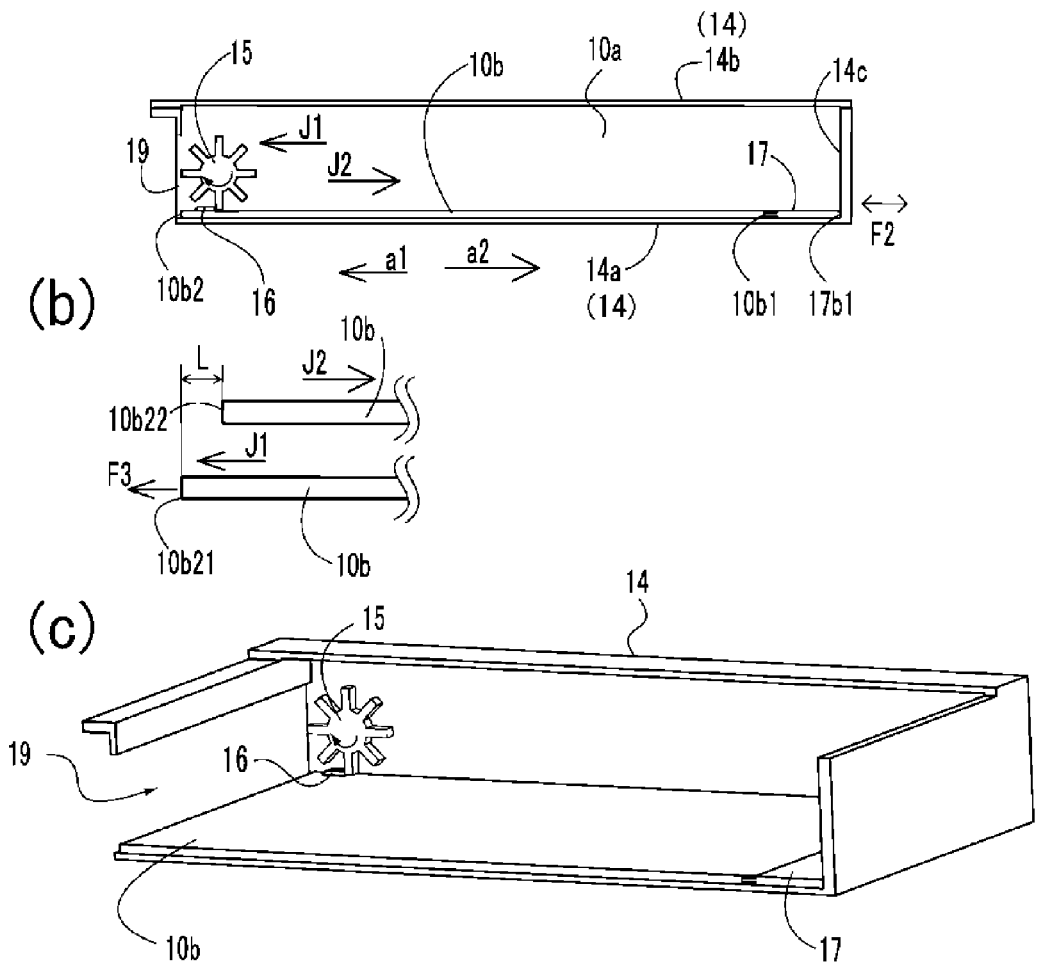
In FIG. 6, (a) is a sectional view of a developer feeding mechanism according to a modified example of Embodiment 3, (b) is a partly enlarged sectional view of (a) of FIG. 6, and (c) is a perspective vie of the developer feeding mechanism.

FIG. 6 includes schematic views of a developer feeding mechanism in which the feeding member 10*b* is connected with an elastic member 17. In FIG. 6, (a) is a sectional view of the developer feeding mechanism, (b) is a partly enlarged view of (a) of FIG. 6, and (c) is a perspective view of the developer feeding mechanism. Incidentally, in this modified example, it can be defined that the feeding member 10*b* and the elastic member 17 constitute the feeding member.

The feeding member 10*b* is formed of the general-purpose plastic material. The elastic member 17 is formed of the general-purpose elastomer material. Further elastic member 17 is connected with the fixing portion 10*b*1 of the feeding member 10*b* in a left side, and is connected with a rear end portion 14*b* of the accommodating container 14 in a right side.

Here, the case where the feeding member 10*b* is moved by the cam member 15 is illustrated, but the feeding member 10*b* may also be moved by the vibration applying device such as the piezoelectric element.

As described above, in Embodiment 3, it can be said that all or a part of the feeding member 10*b* is formed with the elastic member 17. Further, in this embodiment, the elastic member 17 may be the elastomer, but may also use another member, showing elasticity, such as a spring. Here, the above-described elastic member 17 is essential to the case where the elastic member 17 is constituted as the vibration applying member 10*b* which applies the force only in one direction, but is not essential to the case where the elastic member 17 is constituted as the vibration applying member 10*b* capable of generating a reciprocating force in the feeding surface direction F2.

Embodiment 4

4. Toner Feeding by Wavelength Change of Standing Wave (Mechanism 2)

Figure 7:
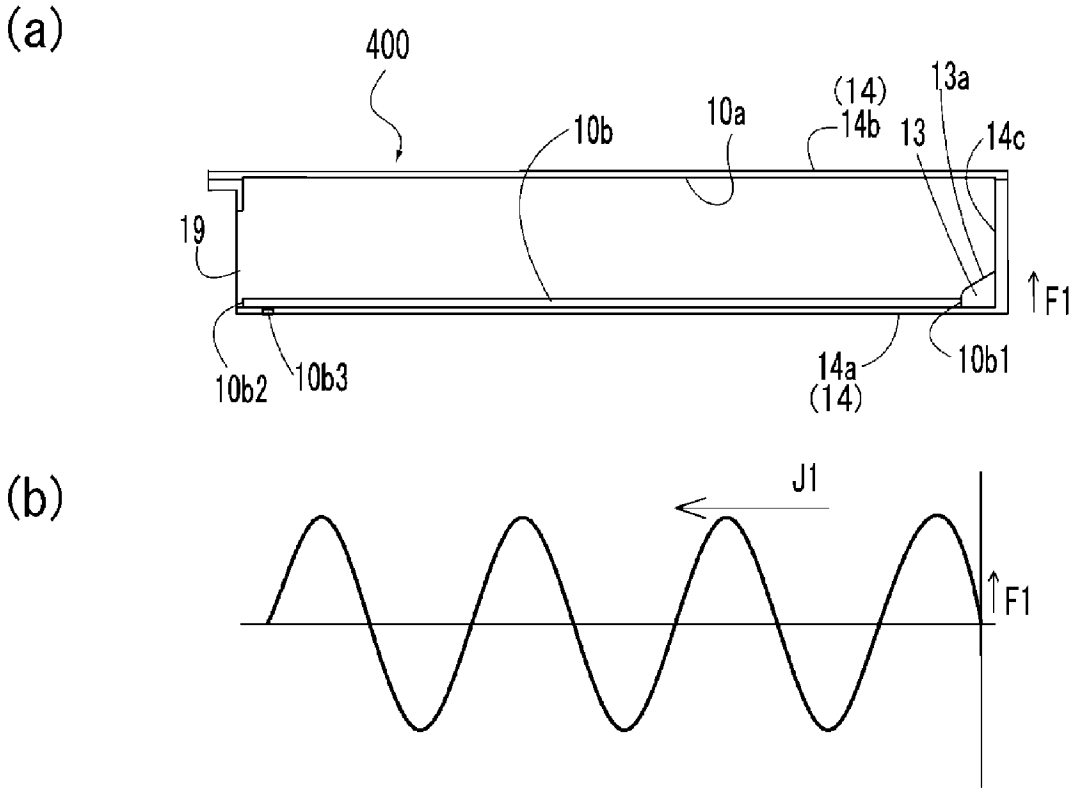
In FIG. 7, (a) is a sectional view of a developer feeding mechanism according to Embodiment 4, and (b) is a waveform chart of a standing wave in Embodiment 4.
Figure 8:
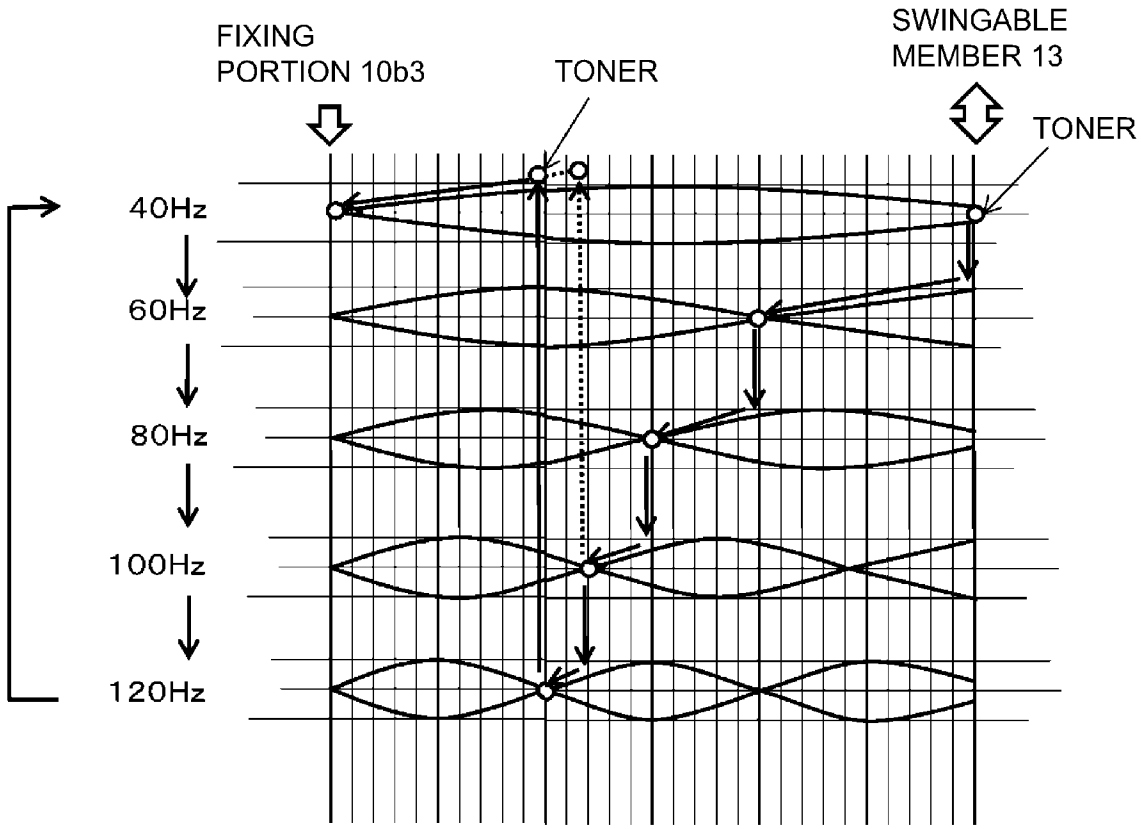
FIG. 8 is a graph showing positions of nodes of frequencies used for the developer feeding mechanism in Embodiment 4.

Here, the toner feeding constitution of the developer feeding mechanism is not limited to the constitution described above. For example, the toner feeding constitution may also be a toner feeding constitution of a developer feeding mechanism 400 shown in FIG. 7. In FIG. 7, (a) is a sectional view of the developer feeding mechanism 400 according to Embodiment 4, and (b) is a waveform chart of a standing wave. FIG. 8 is a schematic view showing a waveform chart and a state of movement of the developer. Of constituent elements in Embodiment 4, those identical to those in Embodiments 1 to 3 are represented by the same reference numerals or symbols and will be omitted from description. The description in each of Embodiments 1 to 3 is applied to also this embodiment.

(Toner Feeding Constitution of Developer Feeding Mechanism)

The toner feeding constitution of the developer feeding mechanism 300 in this embodiment will be described specifically with reference to FIGS. 1, 2, 7 and 8. Here, the developer feeding mechanism 400 includes the accommodating container 14, the feeding member 10*b* and the vibratable member 13.

Further, as a material for the feeding member 10*b*, a 300 μm-thick silicone rubber was used, but the material is not limited to the silicone rubber.

The material for the feeding member 10*b* can also be appropriately constituted by a general-purpose elastomer material such as acrylic rubber, natural rubber or butyl rubber. The material for the feeding member 10*b* may also be a general-purpose plastic material such as polyethylene terephthalate (PET), polystyrene (PS), polyethylene (PE), polypropylene (PP), ABS resin, polycarbonate (PC) or polyacetal (POM).

As shown in FIG. 7, the feeding member 10*b* of the toner accommodating portion 10*a* is connected with the vibratable member 13 for transmitting vibration to the feeding member 10*b* at the fixing portion 10*b*1, and is fixed to the container body 14*a* at the fixing portion 10*b*3 in the free end portion 10*b*2 side.

As shown in FIG. 7, the vibratable member 13 applies reciprocating acceleration to the feeding member 10*b* in the perpendicular direction F1 perpendicular to the developer feeding surface to vibrate. A standing wave to be generated from the vibratable member 13 as a (generating) source is generated in the feeding member 10*b* (standing wave generating step). Then, the frequency of the standing wave is increased (frequency increasing step). As a result, the developer is fed in the feeding direction J1 by the feeding member 10*b* (powder feeding method). The frequency of the vibratable member 13 may be of a type in which the frequency increases continuously or a type in which the frequency increases stepwisely. However, first, the case where the frequency increases continuously will be described.

The vibration by the vibratable member 13 is transmitted to the feeding member 10*b* via the feeding direction 10*b*1, so that the feeding member 10*b* vibrates in the toner accommodating portion 10*a*. Here, a vibration frequency ranging from 40 Hz to 120 Hz and an amplitude of about 0.8 mm were selected.

Here, as shown in FIGS. 7 and 8, when the vibratable member 13 is vibrated at 40 Hz, the fixing portion 10*b*1 of the feeding member 10*b* reciprocates in the perpendicular direction F1 to the feeding member 10*b*, so that the vibration is transmitted from the fixing portion 10*b*1 toward the free end portion 10*b*2 of the feeding member 10*b*. At this time, the free end portion 10*b*2 is fixed by the fixing portion 10*b*3, so that reflected wave of the vibration generates. As a result, in the feeding member 10*b*, the standing wave consisting of a combined wave of the progressive wave with the reflected wave is formed.

Here, as shown in FIG. 8, the toner on the feeding member 10*b* gathers at a region (nodes) where the standing wave generated on the feeding member 10*b* little vibrates. From this state, when the frequency is gradually increased continuously to 120 Hz, the wavelength of the standing wave is gradually shortened. This shortening of the wavelength of the standing wave means that the region (nodes) where the standing wave little vibrates moves from the fixing portion 10*b*1 toward the free end portion 10*b*2 in accordance with contraction of the wavelength. Accordingly, also the toner gathering at the region (nodes) where the standing wave little vibrates moves.

In this way, in the case where the frequency is increased continuously, the frequency may only be required to be increased so that the toner gathering at the nodes is moved in the feeding direction J1 with the movement of the region (nodes), where the standing wave little vibrates, in the feeding direction J1.

Here, the frequency is not increased continuously, but may also be increased stepwisely in the order of 40 Hz, 60 Hz, 80 Hz, 100 Hz and 120 Hz with an increment of 20 Hz. In this way, in the case where the frequency is increased stepwisely, the frequency may only be required to be increased to a next-stage frequency after a lapse of a predetermined time from the movement of the toner to the region (nodes) where the standing wave little vibrates.

Then, the increase of the frequency up to 120 Hz is once stopped, and the frequency is returned to 40 Hz and then is increased again. Particularly, it is preferable, in the case where the feeding of the powder is considered, that the frequency is increased continuously or stepwisely up to 120 Hz and thereafter is abruptly decreased to 40 Hz, and then is increased again up to 120 Hz. By repeating this increase and decrease of the frequency, the powder can be fed further efficiently. Further, before the toner moved to the node in the feeding direction J1 when the frequency is 120 Hz is moved to an antinode positioned with respect to the opposite direction J2 to the feeding direction J1, the frequency is decreased continuously or stepwisely from 120 Hz to 40 Hz, and then is increased again.

By repeating this operation, it becomes possible to feed the toner from the fixing portion 10*b*1 toward the free end portion 10*b*2.

That is, this is because the toner moved to the node of 120 Hz is positioned downstream of a region (antinode), with respect to the develop J1, where an amplitude of the standing wave formed at the frequency of 40 Hz becomes maximum, and therefore the toner is fed toward a downstream node with respect to the feeding direction J1.

At this time, a maximum of the frequency of the vibratable member 13 may only be required to be set at a value larger than twice a minimum of the frequency of the vibratable member 13. This is because, as shown in FIG. 8, the node of the frequency of 80 Hz which is twice the frequency of 40 Hz is positioned at the antinode of 40 Hz, and therefore at least a half of the toner is moved to the downstream node with respect to the feeding direction J1.

Here, in general, when the developer is placed on a vibrating plate, it is well-known that the developer is flicked away in the region (antinode) where the standing wave largely vibrates and gathers at the region (node) where the standing wave little vibrates. In this embodiment, the standing wave is formed on the feeding member 10*b*, and the frequency of the standing wave is increased continuously, whereby the region (node) where the standing wave little vibrates was moved. As a result, the toner on the feeding member 10*b* is fed from the fixing portion 10*b*1 toward the free end portion 10*b*2.

Further, the inclined surface portion 13*a* is provided at the upper portion of the vibratable member 13, and therefore the toner on the vibratable member 13 can slip on the inclined surface portion 13*a* by vibration of the vibratable member 13 to reach the feeding member 10*b*. For this reason, the inclined surface portion 13*a* prevents the toner from remaining on the vibratable member 13.

According to the constitution of any one of Embodiments 1 to 4, the dead space inside the toner accommodating portion 10*a* is reduced, so that the developer feeding performance inside the toner accommodating portion 10*a* is improved. That is, by feeding the toner, in the accommodating container 14 extending in the horizontal direction, to the opening 19 by the feeding member 10*b*, it is possible to stably supply the toner to the developing roller 10*d*.

Further, in Embodiments 1 to 4, the case where the container body 14*a* of the accommodating container 14 has the bottom (surface) 14*a*1 which is substantially horizontal when the accommodating container 14 is mounted in the image forming apparatus 100 is illustrated, but there is no need to limit the present invention thereto. For example, the present invention can be suitably applied to also the case where the bottom 14*a*1 of the container body 14*a* of the accommodating container 14 is inclined with respect to the horizontal surface.

Figure 9:
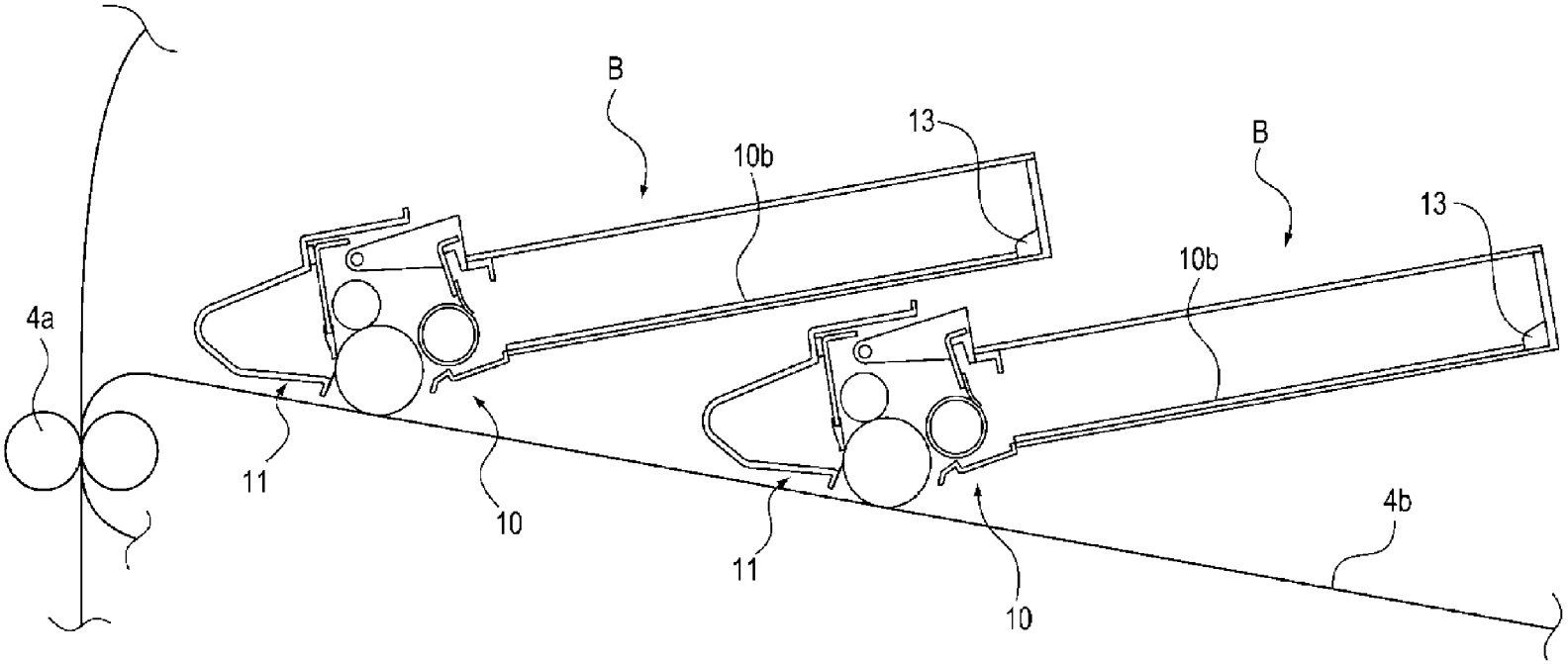
FIG. 9 is a sectional view of a developer feeding mechanism in a modified embodiment.

Further, in Embodiments 1 to 4, the constitution in which the cartridge B was used for forming a single-color image was employed. However, a cartridge in which a plurality of developing means (developing devices) are provided and a plurality of color images (e.g., two color images, three color images or full-color images) are formed may also be used. Further, as shown in FIG. 9, an image forming apparatus including a plurality of cartridges may also be used. In this case, a constitution such that the developer image is transferred from the photosensitive drum onto an intermediary transfer member 4*b* such as a transfer belt, and the transferred developer image is moved to the secondary transfer position and then is transferred onto the recording material such as paper by the secondary transfer roller 4*a* as the transfer means may also be employed.

Further, in Embodiments 1 to 4, the toner feeding embodiment was described, but the present invention is also applicable to toner feeding in a cleaner unit in which the transfer residual toner is collected, and toner feeding in not only the cartridge B but also the developing device and the toner cartridge.

Further, an object to be fed is not limited to the toner, but the present invention is also applicable to another powder such as powdery medicine, wheat or salt.

Incidentally, in Embodiments 1, 2 and 4, the vibratable member (vibration applying member) 13 is disposed inside the toner accommodating portion 10*a*, but the present invention is not limited thereto. For example, the vibratable member 13 may also be disposed outside the toner accommodating portion 10*a* and may be connected with the feeding member 10*b* to transmit the vibration.

Further, in the embodiments described above, the feeding member 10*b* is fixed to the container body 14*a* in the free end portion 10*b*2 side by the fixing portion 10*b*3, but the present invention is not limited thereto. For example, a constitution in which the feeding member 10*b* is not fixed in the free end portion 10*b*2 side and in which a degree of attenuation of the feeding member 10*b* is decreased by changing the material or the shape is employed, so that the present invention can be suitably applied to also the case where the standing wave is formed on the feeding member 10*b* by the vibration transmitted from the vibratable member (vibration applying member) 13.

Further, the frequency at which the vibratable member (vibration applying member) 13 vibrates is 5-100 Hz. Further, with respect to an inclination angle of the feeding member 10*b*, the developer is feedable to the opening 19 even when an ascending angle is less than 10 degrees, and is feedable to the opening 19 even when a descending angle is 60 degrees or less.

Incidentally, an embodiment in which the feeding member 10*b* and the vibratable member 13 are fixed to each other at least at one position, and an embodiment in which the feeding member 10*b* and the cam member 15 as the vibratable member are fixed to each other at least at one position may also be employed.

Further, in the above-described embodiments, the accommodating container 14 is illustrated as the developer accommodating container, but the present invention is not limited thereto. For example, the present invention is suitably applicable to also the case where the developer accommodating container is constituted, as a residual (waste) toner accommodating container for accommodating the residual toner, so as to feed the residual toner.

The constitutions of Embodiments 1 to 4 can be constituted by being appropriately combined. For example, in Embodiment 1, the constitution in which the vibratable member 13 applied the reciprocating acceleration to the feeding member 10*b* in the perpendicular direction F1 perpendicular to the developer feeding surface was employed. However, in contrast thereto, it is also possible to apply the constitution by modifying a structure of the contact portion 16 provided on, in place of the vibratable member 13, the cam member 15 or the feeding member 10*b* in Embodiment 3 (FIG. 5). For example, it is also possible to employ a constitution in which the reciprocating acceleration is applied to the feeding member 10*b* by the cam member 15 and the feeding member 10*b* in the perpendicular direction F1 perpendicular to the developer feeding surface.

Further, in Embodiment 1, the description such that the elastic member was inclined in the feeding member 10*b* was not made. However, in contrast thereto, in place of the feeding member 10*b* in Embodiment 1, it is also possible to apply a constitution in which the elastic member 17 is included in the feeding member in Embodiment 3 (FIG. 6).

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 206714/2013 filed Oct. 1, 2013 and 156566/2014 filed Jul. 31, 2014, which are hereby incorporated by reference.

What is claimed is:

1. A powder feeding mechanism comprising:

a flat feeding member, having a flat surface along which powder moves, for feeding the powder; and a vibration applying member for applying reciprocating acceleration to said feeding member, wherein maximum acceleration applied from said vibration applying member to said feeding member in a powder feeding direction is smaller than maximum acceleration applied from said vibration applying member to said feeding member in a direction opposite to the powder feeding direction to feed the powder in the powder feeding direction by said feeding member, and wherein said vibration applying member vibrates the feeding member at a frequency of 5-100 Hz.

2. A powder feeding mechanism according to claim 1, wherein said vibration applying member is a vibratable member or a rotatable cam member.

3. A powder feeding mechanism according to claim 1, wherein a part or all of said feeding member is formed with an elastic member.

4. A powder feeding mechanism according to claim 3, wherein said feeding member and said vibration applying member are fixed or contacted to each other at least at one position, and wherein said vibration applying member is provided at a position upstream of said feeding member with respect to the powder feeding direction or at a position in a downstream side of said feeding member with respect to the powder feeding direction.

5. A powder feeding mechanism according to claim 1, further comprising an accommodating container for accommodating powder, wherein said feeding member is disposed on a floor surface of said accommodating container.

6. A powder feeding mechanism according to claim 5, wherein said flat surface is parallel to said floor surface.

7. A powder feeding mechanism according to claim 1, wherein said feeding member is formed in a plate shape.

8. A developer accommodating container comprising:

a powder feeding mechanism according to claim 1, wherein the powder is a developer.

9. A cartridge comprising:

a powder feeding mechanism according to claim 1; and a developer carrying member for carrying a developer.

10. A cartridge comprising:

a powder feeding mechanism according to claim 1;

an image bearing member for bearing a developer image; and a developer carrying member for carrying a developer.

11. An image forming apparatus comprising:

a main assembly for image formation; and a powder feeding mechanism according to claim 1, wherein said powder feeding mechanism is detachably mountable to said main assembly.

12. A powder feeding mechanism according to claim 1, wherein said flat surface is parallel to said powder feeding direction.

13. A powder feeding method comprising:

an acceleration setting step of setting acceleration so that maximum acceleration applied from a vibration applying member to a flat feeding member with respect to a powder feeding direction is set at a value smaller than maximum acceleration applied from the vibration applying member to the feeding member with respect to a direction opposite to the powder feeding direction, wherein at least a part of the feeding member is fixed to the vibration applying member, wherein the vibration applying member vibrates to apply reciprocating acceleration to a feeding surface of the feeding member, and wherein the vibration applying member vibrates the feeding member at a frequency of 5-100 Hz; and a powder feeding step of feeding powder in the powder feeding direction set by said acceleration setting step.

14. A powder feeding method comprising:

an acceleration setting step of setting acceleration so that maximum acceleration applied from a vibration applying member to a flat feeding member with respect to a powder feeding direction is set at a value smaller than maximum acceleration applied from the vibration applying member to the feeding member with respect to a direction opposite to the powder feeding direction, wherein the feeding member is expanded and contracted by the vibration applying member when the vibration applying member vibrates, and wherein the vibration applying member vibrates the feeding member at a frequency of 5-100 Hz; and a powder feeding step of feeding powder in the powder feeding direction set by said acceleration setting step.

15. A powder feeding mechanism comprising:

a feeding member for feeding powder; and a vibration applying member for applying reciprocating acceleration to said feeding member in a powder feeding direction along a powder feeding surface of said feeding member, wherein maximum acceleration applied from said vibration applying member to said feeding member in the powder feeding direction is smaller than maximum acceleration applied from said vibration applying member to said feeding member in a direction opposite to the powder feeding direction to feed the powder in the powder feeding direction by said feeding member, and wherein said vibration applying member vibrates at a frequency of 5-100 Hz.

16. A powder feeding mechanism according to claim 15, wherein said flat surface is parallel to said powder feeding direction.

* * * * *